United States Patent [19]

Arita et al.

[11] 4,254,613

[45] Mar. 10, 1981

[54] YARN BREAK DETECTOR IN RING FRAMES

[75] Inventors: Isao Arita, Hirakata; Fumitaka Maede, Kobe, both of Japan

[73] Assignee: Shinzo Kitamura, Hirakata, Japan

[21] Appl. No.: 39,587

[22] Filed: May 16, 1979

[30] Foreign Application Priority Data

May 16, 1978 [JP] Japan ..... 53/58577
Jun. 13, 1978 [JP] Japan ..... 53/71970

[51] Int. Cl.[3] ..... D01H 13/16
[52] U.S. Cl. ..... 57/81
[58] Field of Search ..... 57/81

[56] References Cited

U.S. PATENT DOCUMENTS

| | | | |
|---|---|---|---|
| 3,010,273 | 11/1961 | Bailey | 57/81 |
| 3,099,829 | 7/1963 | Katz | 57/81 X |
| 3,272,048 | 9/1966 | Archer | 57/81 |
| 3,579,407 | 12/1951 | Turner | 57/81 |
| 3,688,958 | 9/1972 | Rydborn | 57/81 X |
| 3,968,637 | 7/1976 | Andel et al. | 57/81 |
| 4,072,935 | 2/1978 | Rydborn | 57/81 X |

*Primary Examiner*—Donald Watkins
*Attorney, Agent, or Firm*—Oblon, Fisher, Spivak, McClelland & Maier

[57] ABSTRACT

Apparatus is disclosed herein which detects breaks in spinning yarns in ring spinning frames or the like and in particular senses vibrations inherent to a yarn guide disposed on a bobbin when the yarn guide comes into contact with the spinning yarns. The apparatus achieves quick inspection of whether breaks occur with the spinning yarns by the presence and absence of the vibrations, thereby monitoring joints in the spinning yarns and the operating state of the spinning machine.

6 Claims, 23 Drawing Figures

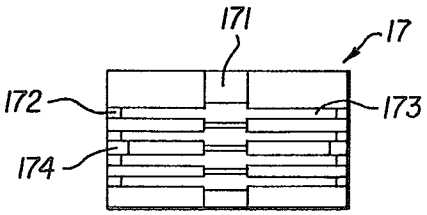
FIG. 11
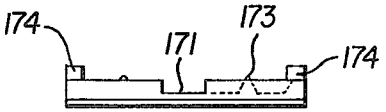
FIG. 12
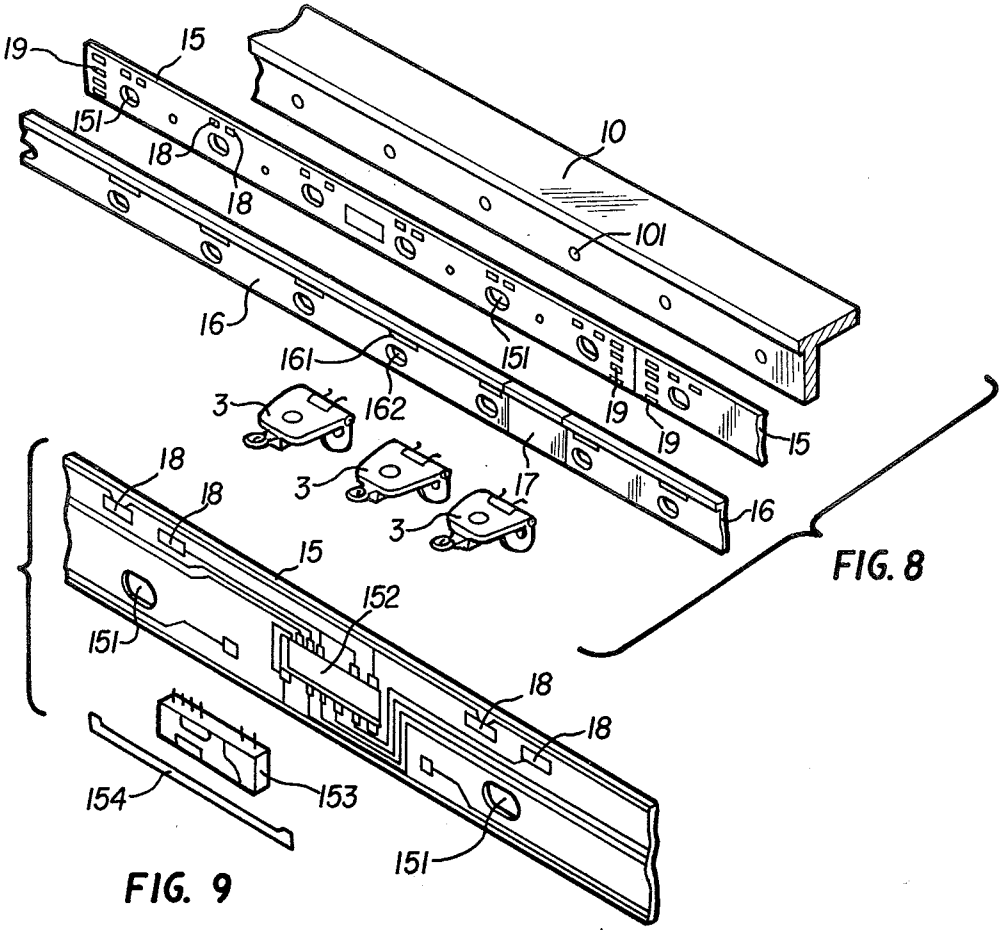
FIG. 8
FIG. 9

16
161
162
152
152
173
175
151
17
174
172
161
162
16

10
102
101
3
2
3
2
3
2
161
15
15
16
162
17
19
19
16
60
61
62
63
65
64
66
66

YARN BREAK DETECTOR IN RING FRAMES

BACKGROUND OF THE INVENTION

1. Field of the Invention

Inherent or unique vibrations occur with a yarn guide disposed on a ring spinning frame when the yarn quide comes into contact with spinning yarns. This invention relates to an apparatus having a piezo-electric element disposed at a yarn guide for sensing the vibrations, a yarn guide installation lappet and electrical connections leading out the output of the piezo-electric element, for the purpose of detecting broken yarns.

2. Description of the Prior Art

In ring frames or other similar spinning machines, early inspections of yarn breaks are of great importance to increase production, minimize refused yarns and prevent failures in advance.

To this end several broken yarn detectors are well known: the photoelectric tube type whereby movements of a flier in contact with yarns due to breaks in the yarns are sensed; the dielectric constant type, etc. Those detectors are divided into two types; those wherein detectors sense yarn breaks in the progress of travelling along spinning yarn lines and those wherein the counterparts are disposed on individual spinning parts.

However, the former or moving type needs a device to move and guide the detectors and in particular substantial expenditures in applying the detectors to the conventional frames. The latter is therefore more desirable. Moreover, the above described photoelectric tube type or dielectric constant type is expensive and it is almost impractical to dispose the detectors at the individual spinning parts, from an economic point of view. There is a requirement that those detectors be disposed at the individual spinning parts and easily applicable to the conventional frames.

Conveniently, yarn guides are disposed on the ring frames for guiding spinning yarns onto bobbins and cause vibrations when coming into contact with the spinning yarns. Another approach which is well known is to sense the vibration for detecting broken yarns through the utilization of a piezo-electric element. It is also well known that the vibrations due to contact with the spinning yarns are discriminated from that accompanying mechanical vibrations of the ring frames in indicators of breaks in yarns.

Nevertheless, no system is suggested which picks up collectively the electromotive forces of piezo-electric elements disposed on a multiplicity of yarn guides and detects their unique vibrations. In addition, there is no suggestion on a specific structure of lappets for leading out signals developed from the piezo-plectric elements.

SUMMARY OF THE INVENTION

It is therefore an object of the present invention to provide a yarn break detector in which vibration sensing yarn guides are easily applicable to the conventional ring frames or the like. It is another object of the present invention to provide a lappet structure for installation of vibration sensing yarn guides and a means for leading electric signals out from lappet bars.

BRIEF DESCRIPTION OF THE DRAWINGS

Various other objects, features and attendant advantages of the present invention will be more full appreciated as the same becomes better understood from the following detailed description when considered in connection with the accompany drawings, wherein like reference characters designate like or corresponding parts throughout the several views, and wherein:

FIG. 8 is a perspective view of circuit boards secured in front of a lappet bar;

FIG. 9 is a partly enlarged view of FIG. 8;

FIG. 11 is a plan view of a bearing surface of a coupling board;

FIG. 12 is a bottom view of FIG. 11;

DETAILED DESCRIPTION OF INVENTION

Figure 1:
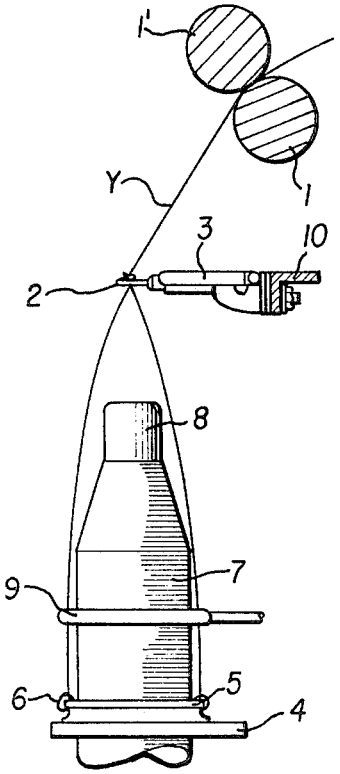
FIG. 1 is a cross sectional side view of a ring frame embodying the present invention.

Referring now to FIG. 1, there is illustrated a representative example of a ring spinning frame in which spinning yarns Y are drawn out from a pair of front rollers 1, 1' and wound up on a bobbin 8 while being guided by a yarn guide 2. The spinning yarns Y are twisted and wound up to form a cup 7 during rotation of the bobbin 8 since the yarns are wound about the bobbin 8 via a link ring 5 movable up and down on a ring rail 4 and a rotatable traveller 6. An anti-node ring is labeled 9. The yarn guide is mounted on a lappet 3 which in turn is supported on a lappet bar 10. The yarn guide 2 is adjustable in position on the lappet 3, while the lappet bar 10 is slidable up and down along a spindle of the bobbin 8.

The present invention successfully utilizes as a yarn break detector the above described structure of the yarn guide 2. A piezo-electric element 12 is secured on part of the yarn guide 2, the output of the piezo-electric element 12 being led out for yarn break detecting purposes. It will be noted that high frequency vibrations occur in the yarn guide 2 on its contacting the spinning yarns Y. Such vibrations are mixed with mechanical vibrations of the ring frame. The mechanical vibrations occur at about 1 KHz, while the yarn guide, in fact, vibrates at about 15 KHz. It has been found that the latter are vibrations inherent to the yarn guide and substantially independent of the pressure of contact with the spinning yarns Y and the rate of the traveling yarns Y. Accordingly, breaks in yarns can be detected by discriminating the inherent or unique vibrations from the mechanical vibrations. As a vibration sensing measure, a piezo-electric element is employed of the type in which the electromotive force is measured in sensing the unique vibrations. The yarn guide embodying the present invention is, therefore, provided with a piezo-electric element of which the electromotive force is easily led out for detecting purposes. It is required that the yarn guide 2 be adjustable with respect to and detachable from the lappet 3 and the lappet 3 be also detachable from the lappet bar 10. The lappet 3 is usually of the spring hinge type which always holds the yarn guide 2 at a fixed level. As noted earlier, the present invention provides a vibration detector which fulfills these requirements.

Figure 2:
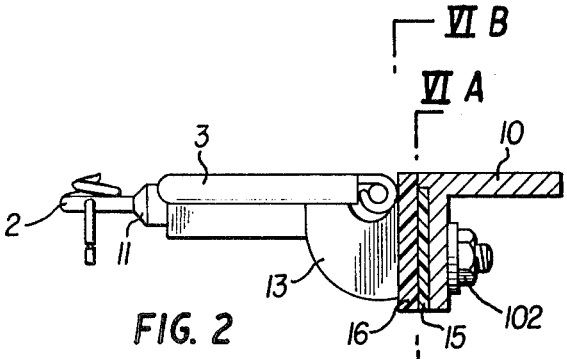
FIG. 2 is an enlarged view of a lappet illustrated in FIG. 1.
Figure 4:
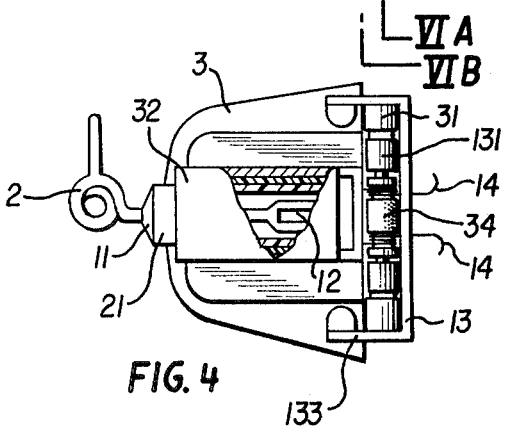
FIG. 4 is a rear view, partly in cross section, of the lappet.
Figure 5:
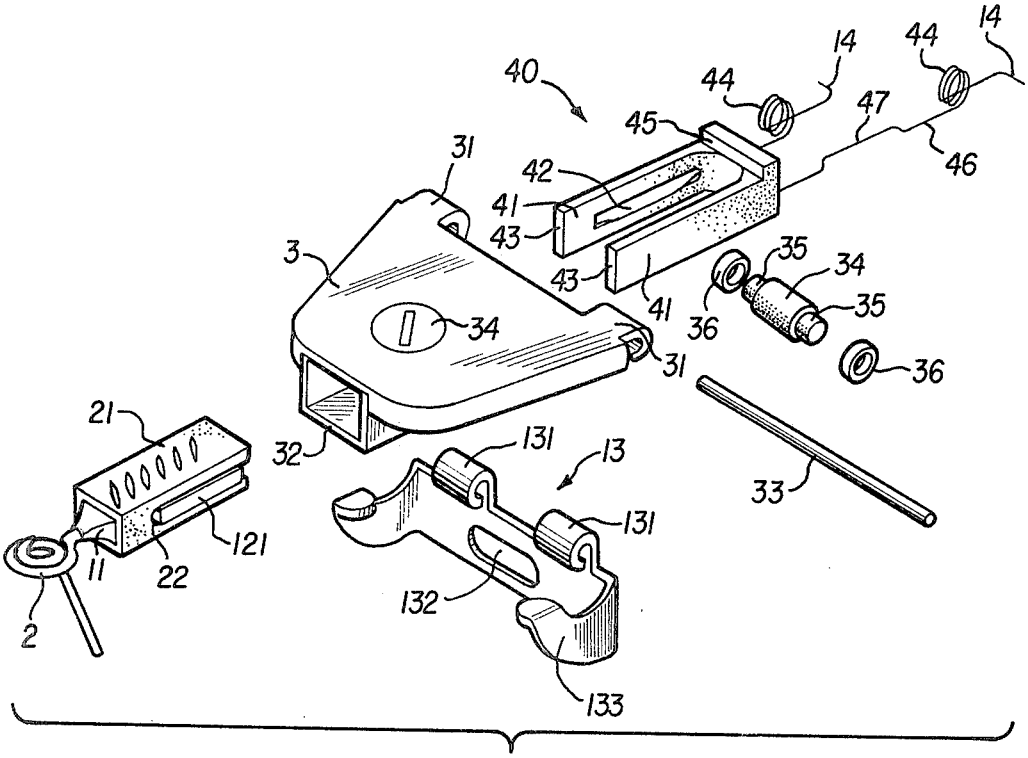
FIG. 5 is an exploded perspective view of the lappet illustrated in FIGS. 2 and 4.

FIG. 2 is a cross sectional view in which the yarn guide 2, the lappet 3 and signal leading means are mounted on the lappet bar 10 according to the present invention. The lappet 3 is secured on the lappet bar 10 via an insulator board 16 and a circuit board 15 on the rear of the insulator board 16. The lappet 3 is of the hinge shape on a lappet bracket 13. The yarn guide 2 is adjustably mounted on the front side of the lappet 3. The piezo-electric element 12, as indicated in FIG. 4, has a flat side bonded to the yarn guide 2 via an adhesive. Conveniently, the yarn guide 2 used with the present invention is springily held on a holder 21 as denoted by 11. The holder 21 is of a cylindrical shape as shown in FIG. 5 having two slots 22 one of which is not shown. Leads from the piezo-electric element 12 are connected to an electrically conductive plate 121 received within the slots 22. The yarn guide 2 is exchangeable together with the holder 21. A slide hole or slot receptor 32 is formed in the bottom of the lappet 3 for urging the yarn guide holder 21 downwardly. A "U" shaped member 40 is inserted into the slide slot receptor 32 from the rear. The holder 21 and the "U" shaped member 40 both are made of insulating material. Slots 42 are formed inside fingers 41 of the "U" shaped member 40, respectively. The fingers 41 pass through the slots 42. An aperture at the tip thereof is labeled 43.

Electrically conductive wires 46 are inserted into the slots 44 and the aperture 43, the wire consisting of a coil section 44, a terminal section 14 and a contact section 47 springily folded inwardly from the slot 42. The wires 46 are also inserted into the slots 42 and the aperture 43 beginning with the contact section 47 thereof. Electrically insulating collar rings are disposed on both sides of the coil sections 44 via necks 35 of an electrically insulating cylinder 34. A stopper 45 is formed on the rear side of the "U" shaped member 40 for limiting the insertion positions.

The bracket 13 of the lappet 3 carries two hinge pivots 131 and lappet holding arms 133. An installation screw hole is labeled 132. The lappet 3 has hinge pivots 31 at its rear end. The "U" shaped member 40 is inserted into the slide slot receptor 32, the cylinder 34 is disposed between the pivots 131 of the bracket 13 and the pivots 31, the bracket hinge pivots 131 and the cylinder 34 of the lappet 3 are connected by a shaft 33, thereby completing assembly of the lappet 3. The yarn guide holder 21 is inserted into the slide slot receptor 32 in the lappet 3 as indicated in FIG. 4 and the leads of the piezo-electric element 12 are connected to the terminal sections 14 via the wires 46.

Figure 3:
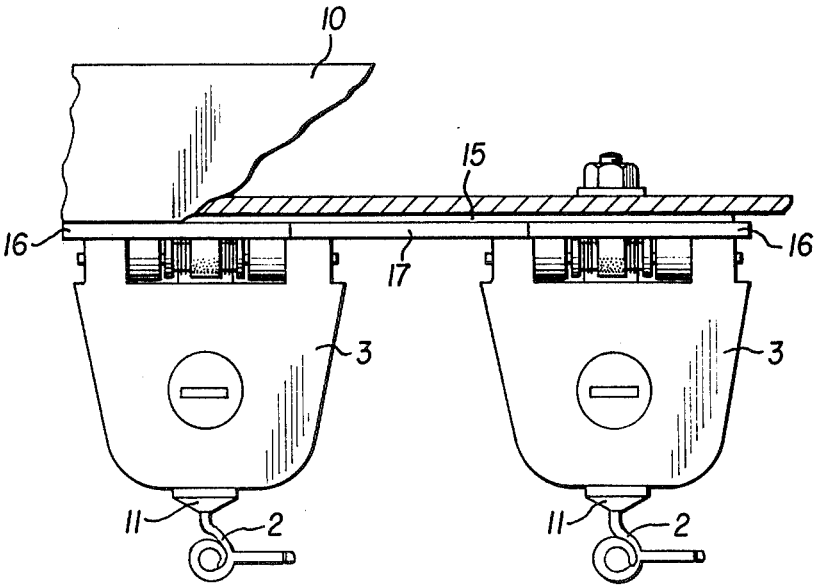
FIG. 3 is a plan view of FIG. 2 illustrating only two divided lappet bars.

In installing the yarn break detecting lappet 3 on the conventional lappet bar 10, care should be taken that the respective terminals 14 be surely electrically connected and the lappet 3 be exchangeable and adjustable in installation position to a certain degree. Since approximately 200 lappets are disposed on both sides of the frame in precise ring spinning machines, it is necessary that the insulating plate 16 and the circuit board 15 be divided for 4–8 weight use and it is favorable that these boards be of the same size. Moreover, it is inconvenient to dispose a multiplicity of lead wires in the vicinity of the lappet bar 10 from a productivity point of view. The present invention, therefore, provides a new structure for the circuit boards which are designed to pick up and transmit signals on the individual yarn guides. As viewed from FIG. 3, the circuit boards 15 are disposed closely to one another and electrical connections are formed on both sides of the circuit boards in such a way that the coupling boards 17 carrying junctions with the insulating board 16 are held in contact with the lappet bars 10 under pressure by the action of the adjacent lappets. As is clear from FIG. 8, the circuit boards 15 are disposed on the lappet installation side (the front face) of the lappet bars 10 and sandwiched between the insulating boards 16 by means of lappet installing bolts and nuts. By the nuts 102 (FIG. 2) the lappet installing bolts (not shown) are fastened to run through the hole 132 (FIG. 5) in the lappet bracket 13, a hole 162 formed in the insulating board 16, a hole 151 in the circuit board 15 and an installing hole 101 in the lappet bar 10. Each circuit board 15 carries a printed circuit pattern on one major surface of an electrically insulating material. Although the drawings illustrate these circuit boards 15 and insulating boards for six-weight use, it is obvious that they are equally applicable to four-to eight-weight uses. Electrical connections 18 leading to the terminals 14 are disposed above the installing holes 151 in the circuit boards 15, respectively. Above the installing hole 162 in the insulating board 16 there is formed an elongate slot 161 through which the terminals 14 extending backwardly from the lappet 3 run. When the lappets are installed as stated above, the terminals are in contact with the connections 18 to establish electrically conductive paths via the elongate slot 161.

Figure 6A:
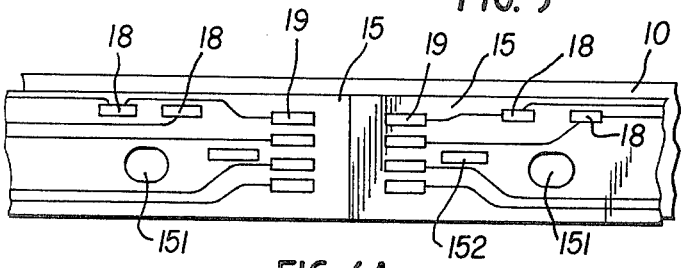
FIG. 6 is a cross sectional view taken on the lines A—A and B—B of FIG. 2.
Figure 6B:
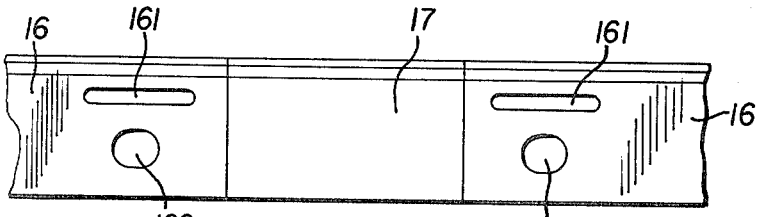
Figures 10, 13, 14:
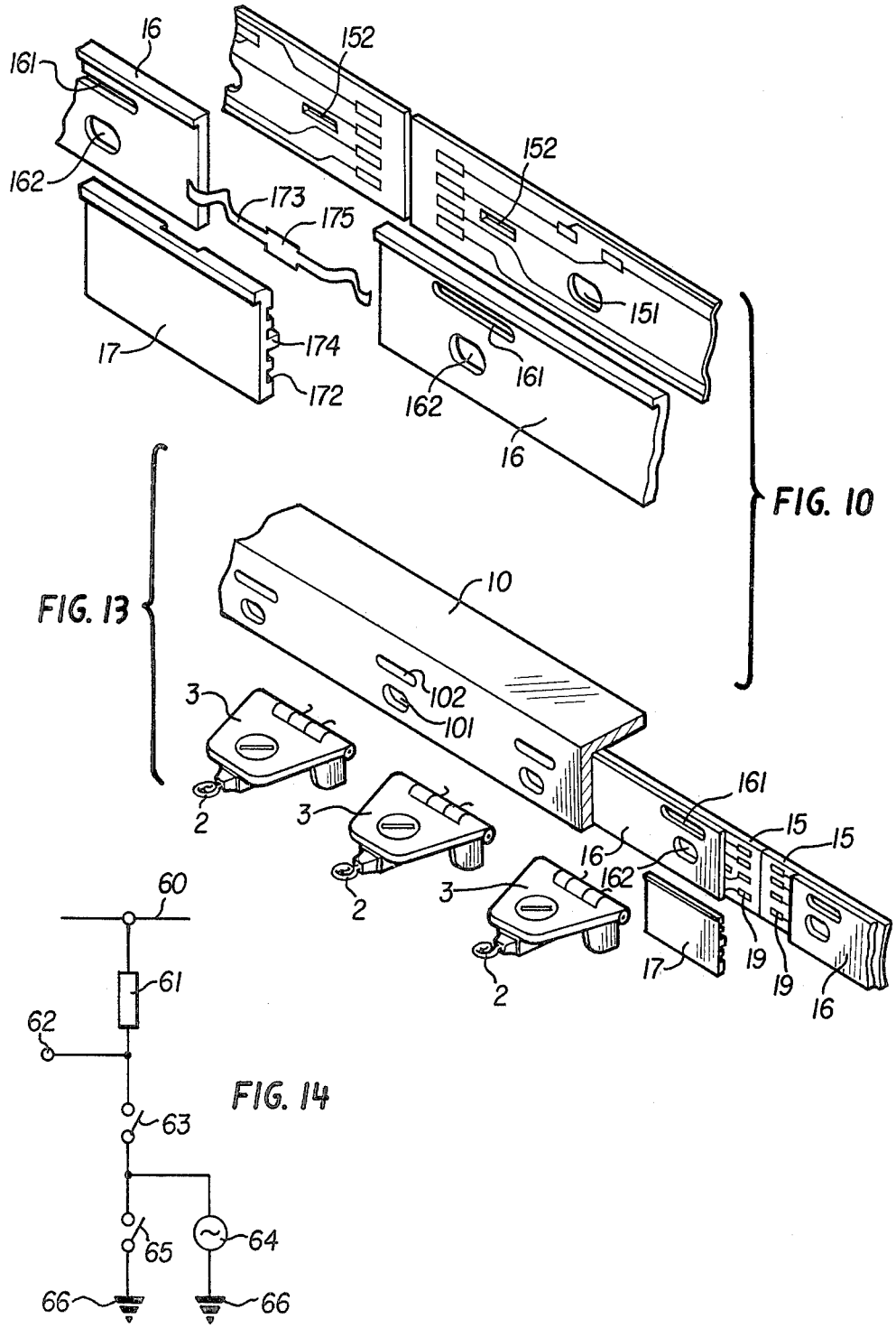
FIG. 10 is a perspective view of electrical connections on the circuit boards.
FIG. 13 is a perspective view of another preferred form of the present invention.
FIG. 14 is a circuit diagram showing the operating principle of a signal detector.

The circuit board 15 is electrically connected as depicted in FIG. 6 taken on the lines A—A and B—B of FIG. 2. The circuit board 15 carries electrically leading symmetric regions 19 at the both ends thereof. Each of the insulating boards 16 is shorter than the full length of the circuit boards 15 and held in contact with the circuit boards 15 except for the lead regions of the circuit boards 15. The coupling board 17 is disposed about the lead regions of the circuit boards 15 and the lead regions 19 of the circuit boards 15 are electrically connected to each other. As indicated in FIG. 10, connectors 173, with the number thereof corresponding to the number of the stepwise lead regions, are disposed at the back of the coupling board 17. As indicated in FIGS. 11 and 12, a longitudinal slot 171 and a lateral slot 172 are formed in each connector 173 for holding the connector. Projections 174 are formed on the slot forming side of the coupling board 17 and inserted into holes 152 (FIG. 6A)

formed in the proximity of the lead regions 19 of the circuit board 15 for defining the position of the coupling board 17. Portions of both sides of each respective connector 173 are folded to extend from the surface of the coupling board 17 and contact electrically the lead areas 19 by the pressing action of the coupling board 17. As already described with respect to FIG. 3, the coupling board 17 is held on the lappets 3.

Figure 7:
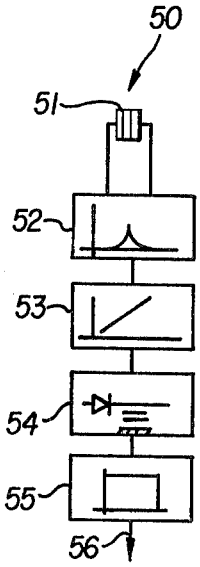
FIG. 7 is an explanatory diagram of an amplifier and detector section for a piezo-electric element.

In FIG. 7, there is illustrated a schematic diagram of a signal detector 50 operatively associated with the piezo-electric transducer 12 on the yarn guide 2. Two leads from the piezo-electric element 51 are connected to a band-pass amplifier 52 which picks up the inherent vibration frequency component within the signals from the piezo-electric element. The inherent vibration component is then amplified up to a definite level through an amplifier 53. A rectifying filter 54 converts alternating current signals into direct current signals. A voltage comparator 55 is adapted to decide a voltage region wherein normal operation is guaranteed and provide logic signal outputs 56.

However, it is rather difficult to dispose such a detector 50 for each of the respective lappets because of an increase in cost of equipment. It is therefore desirable to detect and indicate the vibrations in a collective fashion. The piezo-electric elements 12 on approximately 200 yarn guides should be scanned for a brief period of time for detecting their unique vibrations. It is also necessary to detect approximately 400 signals since the lappets are disposed on both sides of the ring frame.

Figure 15:
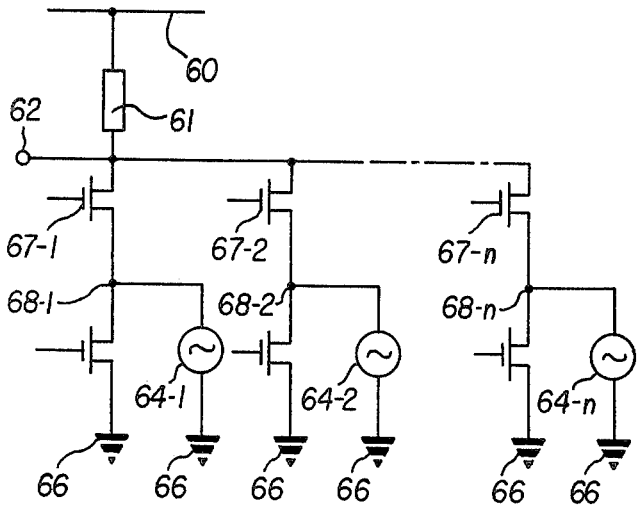
FIG. 15 is a circuit diagram of a signal detection and transmission circuit.
Figure 16:
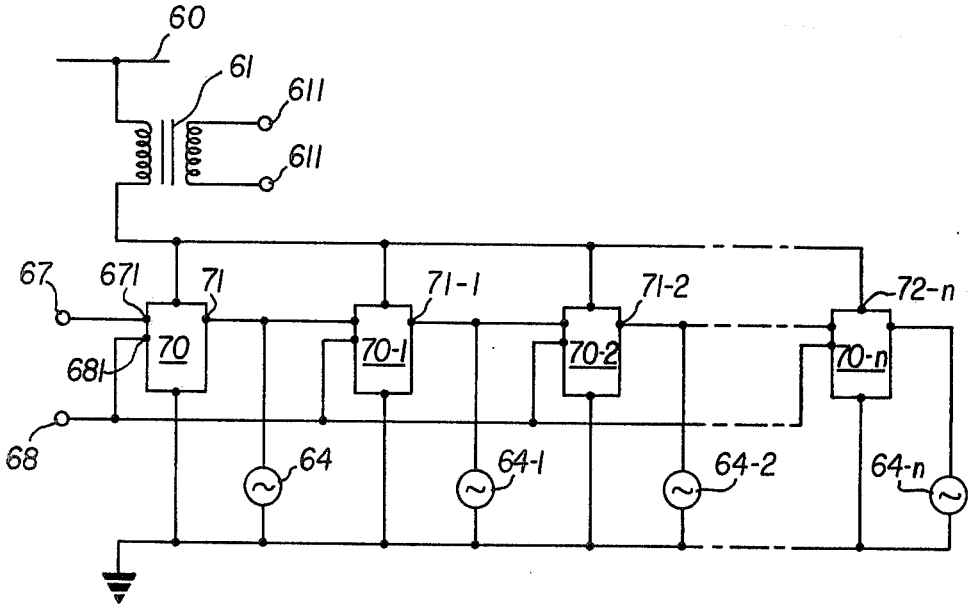
FIG. 16 is a block diagram of the signal detection and transmission circuit.
Figure 17:
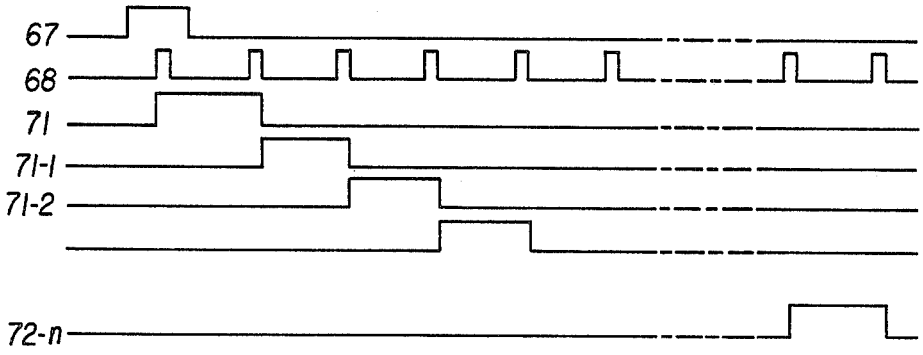
FIG. 17 is a timing chart.

The present invention provides a means for selecting and transmitting a number of alternating current electric signals. FIG. 14 shows a unit circuit of the basic signal transmission circuitry which includes a positive voltage source 60, a load 61, an output terminal 62, switches 63, 65, a source 64 of alternating current signals and an OV voltage source 66. With such an arrangement, when the switch 65 is closed and the switch 63 remains opened, the output of the alternating current signal source 64 is short-circuited so that no signal is transmitted therefrom. If the switch 63 is closed and the switch 65 is opened, then the output of the alternating current signal source 64 enables alternating current to flow to the load 61 via the switch 63 and an alternating current signal voltage is developed between the voltage source and the output terminal 62, the resulting signal voltage being useful for the purpose of detecting the vibrations. The switches 63, 65 may be implemented similarly with semiconductor switches, preferably, MOS (field effect mode) transistors having excellent leak and cut-off properties. FIG. 15 depicts a circuit construction in which a number of the alternating current signal sources 64 are connected. When semiconductor switches 67-1, 67-2, . . . 67-n and 68-1, 68-2, . . . 68-n are switched ON and OFF if necessary, the alternating current sources 64-1, 64-2, 64-n are selected to convey any signals to the output terminal 62 via the selected signal sources. FIG. 16 is a circuit diagram of an implementation of the circuit of FIG. 15 by means of a C-MOS type digital IC shift register. This circuit further includes the positive voltage source 60 and the load 61 of a transformer of which the secondary output is labeled 611. The shift register has a data input terminal 67 and a clock pulse input terminal 68. Each of the latch type flip flops 70 has a D input 671, a clock input 681 and an output. A timing chart associated with the shift register construction is illustrated in FIG. 17, which depicts the developments of the data output 67 and the outputs 71, 71-1, 71-2, 72-n of the shift register clock 68 which comprises a semiconductor switch circuit as in FIG. 16. When the clock output is at a high level, the signals are transmitted from the alternating current signal sources 64, 64-1, 64-2, 64-n into the positive voltage line 60 and when the same is at a low level all the signals are short-circuited. Accordingly, the alternating current signal sources 64, 64-1, 64-2, . . . 64-n are selected in sequence by the shift register data input 67 and the shift register clock pulses 68 so that the various signals from the alternating current signal sources may be transmitted onto a common bus line by the shift register scanning. In installing these circuit elements on the circuit boards 15, as indicated in FIG. 9, holes 152 are formed at the center of the circuit boards 15 and surrounded by the lead areas. The C-MOS type digital IC shift register 153 is secured within the hole 152 with its terminals connected to the lead areas of the circuit board 15. Since the circuit boards 15 used with the present invention are those having a major surface overlaid with copper, the IC shift register 153 is secured by means of a jumping connector 154.

The above structure makes it easy to select and transmit the signals of the multiplicity of alternating current signal sources for the purpose of detecting the individual alternating current signals. In addition, in the case where the yarn break detector is applied to the ring frame, an indicator may be provided for one side or both sides of the frame or for each block of the frame. This eliminates the need for the operator or supervisor to carry out time-consuming yarn jointing operations.

Although in the foregoing description the circuit boards 15 and the insulating board 16 are disposed at the front surface of the lappet bar 10, they may be installed inside the lappet bar 10 for the purpose of the present invention. In this case an aperture 102 is formed in the installing surface of the lappet bar 10 for receiving the terminals 14 of the lappet and the coupling board 17 is disposed on the rear surface of the lappet bar. Other forms of the lappet 3 may be available as long as the leads of the piezo-electric element 12 on the yarn guide 2 extend backwardly. FIGS. 18 through 22 represent examples of the other forms of the lappet 3. The whole of a lappet 30 is made of plastic material except for the yarn guide 2. The yarn guide 2 and its installing means are similar to that in FIG. 15. The lappet 30 has a slot receptor 307 for insertion of the yarn guide holder 21 and further two slots 305 for receiving flexible contact arms 306. In the illustrated example, the lappet 30 carries no spring and a bracket 300 is of a hinge shape. It is thus difficult to form terminals 310 extending toward the back side of the bracket 300 integrally with the contact arms 306. For this reason a hinge pivot 312 is made of electrically conductive material for connecting the flexible contact arms 306 and terminal leaves 310. The terminal leaves 310 have holes 311 on their one side, the holes 311 being not completely formed in such a way that the tip of the pivot 312 is flexibly inserted thereto. The terminal leaves 310 are inserted into slots 304 formed in the bracket 300.

Figure 21:
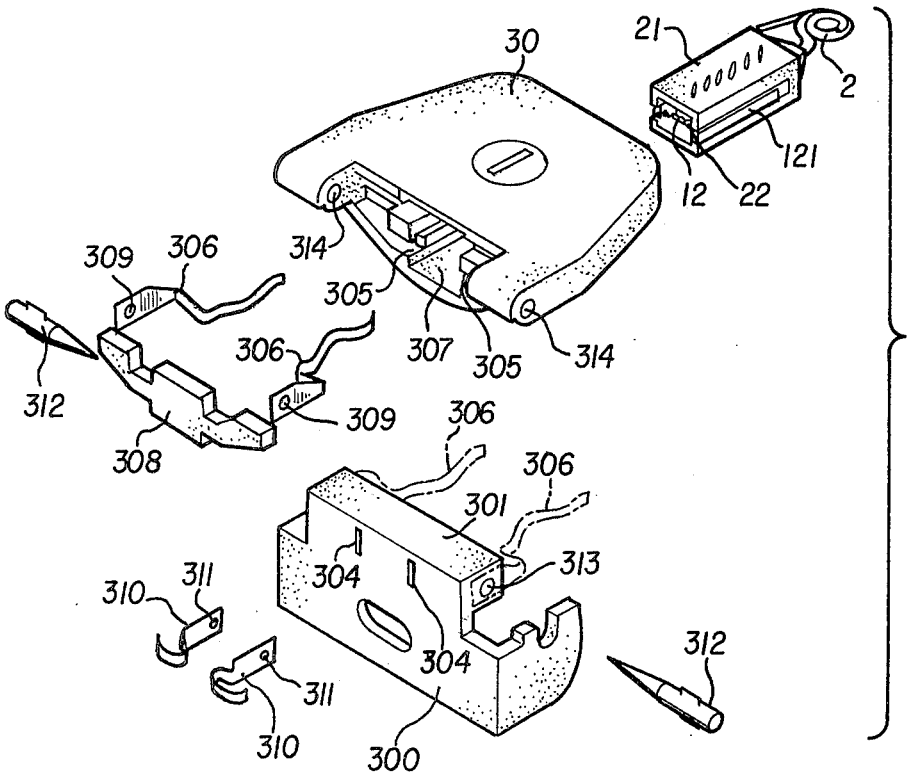
FIG. 21 is an exploded perspective view of the lappet shown in FIG. 17.
Figure 18:
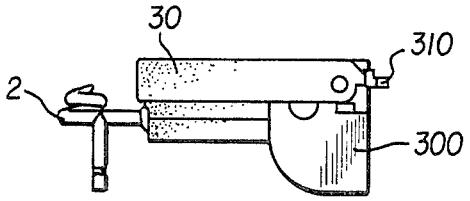
FIG. 18 is a side view of another form of the lappet used according to the present invention.
Figure 19:
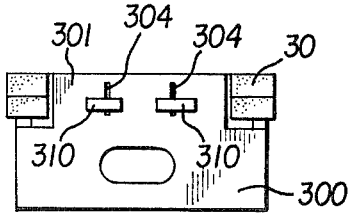
FIG. 19 is a right side view of FIG. 17.
Figure 20:
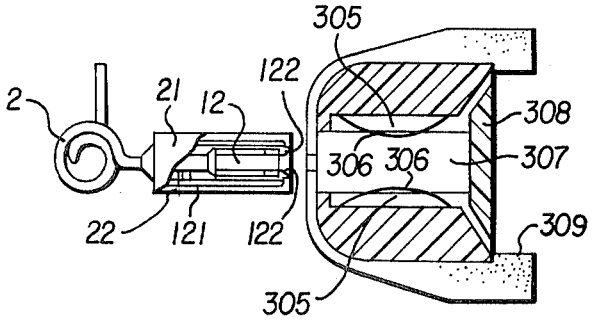
FIG. 20 is a cross sectional view of a yarn guide mounting section shown in FIG. 18 and a lappet mounting section.
Figure 22:
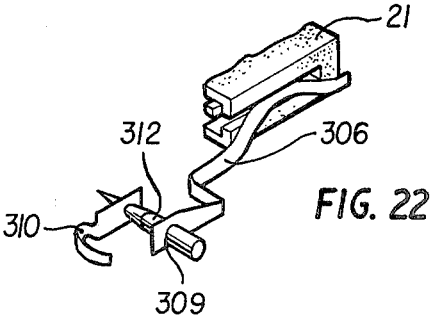
FIG. 22 is an explanatory diagram of a part of FIG. 21.

The contact arm 306 is shaped as shown in FIG. 21 and 22 and disposed as in FIG. 20. The contact arm 306 has a hole 309 at its one end to normally electrically connect a body of the pivot 312. Moreover, the contact arm 30 is disposed in agreement with the hole 313 which runs through the hinge section 301 formed on the top of the bracket 300, by means of a concealing member 308 closing the rear side of the slot receptor 307.

The pivot 312 is secured to penetrate inserting holes 314 on both sides of the rear edge of the lappet 30, the hole 309 in the contact arm 306, the hole 313 in the bracket and the hole 311 in the terminal 310. In this way, the contact arms 306 are electrically connected to the terminals 310 via the pivot 312, respectively. Both leads of the piezo-electric element 12 are also connected to the terminals 310 as viewed from FIG. 22 by inserting the yarn guide holder 21 into the slot 307 in the lappet 30.

The above discussed plastic lappet 30 is electrically nonconductive and thus suitable to hold the break detecting yarn guide 2 of the present invention.

Obviously, many modifications and variations of the present invention are possible in light of the above teachings. It is therefore to be understood that within the scope of the appended claims, the invention may be practiced otherwise than as specifically described herein.

We claim:

1. A yarn break detector for a ring frame, comprising:

a yarn guide adapted to contact spinning yarns;

a piezoelectric element having leads and mechanically coupled to said yarn guide for detecting vibrations of said yarn guide;

a holder for supporting said yarn guide and for housing said piezoelectric element, said holder having a pair of slots in which are mounted respective conductive plates each electrically connected to a respective lead of said piezoelectric element;

a lappet having a guide side and an installation side and including, a slide receptor extending from said guide side toward said installation side, a U-shaped member having a pair of slotted fingers adapted to be mounted within said slide receptor, electrically conductive members extending from said installation side into the slots of said fingers, each having spring loaded contact portions emerging from said slotted fingers for making contact with a respective conductive plate and an installation portion for making electrical connection thereto at said installation side;

wherein said holder is adapted to be mounted within said fingers of said U-shaped bracket within said slide receptor with the conductive plates completing the electrical connection between said piezoelectric element leads and said electrically conductive members.

2. A yarn break detector according to claim 1, further comprising:

a lappet supporting bar to which said installation side is connected;

circuit boards divided into sections and disposed on said lappet supporting bar, said leads being connected to said circuit boards; and insulating boards divided into sections and disposed to cover said circuit boards;

wherein said circuit boards have lead areas at both sides thereof for connecting each said circuit board to adjacent circuit boards.

3. A yarn break detector according to claim 2 wherein a coupling board connecting the circuit boards has connectors at its lead regions and is held by said lappet to occupy a space about the insulating board.

4. A yarn break detector according to claim 1, further comprising:

a pair of power supply lines;

a load connected to one of said power supply lines;

first and second series connected switches connected in series with said load across said power supply lines, said first switch connected to said load;

said installation portions of said electrically conductive members connected in parallel across the other of said power supply lines and the series connection point of said first and second switches;

drive means for switching said first switch to a low impedance state and said second switch to a high impedence state to selectively connect said piezoelectric element to said load and for switching said first switch to a high impedance state and said second switch to a low impedance state to selectively disconnect said piezoelectric element from said load.

5. A yarn break detector according to claim 4, further comprising:

said first and second switches formed of a single stage of a multi-stage digital shift register; and said drive means comprising a preceding stage of said shift register.

6. A yarn guide detector according to claim 1, further comprising:

said lappet comprising a hinge portion; and said electrically conductive members including helically wound portions disposed on said hinge portion.

* * * * *

UNITED STATES PATENT AND TRADEMARK OFFICE

CERTIFICATE OF CORRECTION

PATENT NO. : 4,254,613

DATED : March 10, 1981

INVENTOR(S) : Isao Arita et al

It is certified that error appears in the above—identified patent and that said Letters Patent is hereby corrected as shown below:

Front page, left hand column, in between sections (22) and (51), insert-- (30) FOREIGN APPLICATION PRIORITY DATA Feb. 6, 1979 Japan 54/13046 --.

Signed and Sealed this

*Fourteenth* Day of *July 1981*

[SEAL]

*Attest:*

GERALD J. MOSSINGHOFF

*Attesting Officer*

*Commissioner of Patents and Trademarks*